US010214971B2

(12) United States Patent
Logan et al.

(10) Patent No.: US 10,214,971 B2
(45) Date of Patent: Feb. 26, 2019

(54) APPARATUS FOR ANGULAR ALIGNMENT OF DOWNHOLE SENSORS WITH HIGH SIDE IN DIRECTIONAL DRILLING

(71) Applicant: EVOLUTION ENGINEERING INC., Calgary (CA)

(72) Inventors: Aaron W. Logan, Calgary (CA); Patrick R. Derkacz, Calgary (CA); Justin C. Logan, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 712 days.

(21) Appl. No.: 14/649,000

(22) PCT Filed: Dec. 17, 2013

(86) PCT No.: PCT/CA2013/050974

§ 371 (c)(1),
(2) Date: Jun. 2, 2015

(87) PCT Pub. No.: WO2014/094153

PCT Pub. Date: Jun. 26, 2014

(65) Prior Publication Data

US 2015/0315899 A1 Nov. 5, 2015

Related U.S. Application Data

(60) Provisional application No. 61/738,389, filed on Dec. 17, 2013.

(51) Int. Cl.
*E21B 17/043* (2006.01)
*E21B 47/01* (2012.01)
(Continued)

(52) U.S. Cl.
CPC ..... *E21B 17/043* (2013.01); *E21B 7/067* (2013.01); *E21B 17/00* (2013.01); *E21B 17/042* (2013.01);
(Continued)

(58) Field of Classification Search
CPC ..... E21B 17/043; E21B 7/067; E21B 17/00; E21B 17/042; E21B 17/05; E21B 47/01; E21B 47/024
(Continued)

(56) References Cited

U.S. PATENT DOCUMENTS 4,303,135 A 12/1981 Benoit et al.
4,575,359 A 3/1986 Bermingham
(Continued)

*Primary Examiner* — Taras P Bemko
(74) *Attorney, Agent, or Firm* — Oyen Wiggs Green & Mutala LLP

(57) ABSTRACT

Adjustment of the angle of a bent sub or other steering feature in a drill string relative to a reference angle of a downhole sensor is facilitated by a rotatable coupling between the bend sub and the sensor. The rotatable coupling may be rotated to align the high side with a reference indicia and locked at the set angle. Calibration of the sensor is facilitated and opportunities for certain measurement errors are eliminated. An embodiment provides a locking mechanism comprising tapered locking fingers which are clamped against a surface by a tapered collar. Rows of ceramic balls retained in circumferential channels may be provided to permit rotation while carrying tensile and compressional forces.

19 Claims, 8 Drawing Sheets

(51) Int. Cl.

| | |
|---|---|
| ***E21B 47/024*** | (2006.01) |
| ***E21B 7/06*** | (2006.01) |
| ***E21B 17/05*** | (2006.01) |
| ***E21B 17/00*** | (2006.01) |
| ***E21B 17/042*** | (2006.01) |

(52) U.S. Cl.
CPC ..... *E21B 17/05* (2013.01); *E21B 47/01* (2013.01); *E21B 47/024* (2013.01)

(58) Field of Classification Search
USPC ..... 166/242.6
See application file for complete search history.

(56) References Cited

U.S. PATENT DOCUMENTS

| | | | | |
|---|---|---|---|---|
| 4,828,050 | A | 5/1989 | Hashimoto | |
| 5,368,110 | A | 11/1994 | French | |
| 5,368,111 | A | 11/1994 | Benoit et al. | |
| 5,419,405 | A | 5/1995 | Patton | |
| 5,458,208 | A | 10/1995 | Clarke | |
| 6,373,248 | B1 | 4/2002 | Poitzsch et al. | |
| 6,942,044 | B2 | 9/2005 | Moore et al. | |
| 2004/0084219 | A1* | 5/2004 | Moore | E21B 4/18 175/73 |
| 2007/0138720 | A1* | 6/2007 | Evans | F16F 1/32 267/162 |
| 2007/0256829 | A9 | 11/2007 | Hosie et al. | |

* cited by examiner

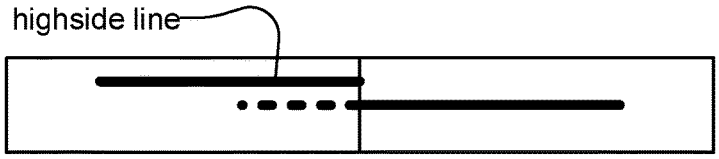
FIG. 1A – PRIOR ART – uphole assembly process
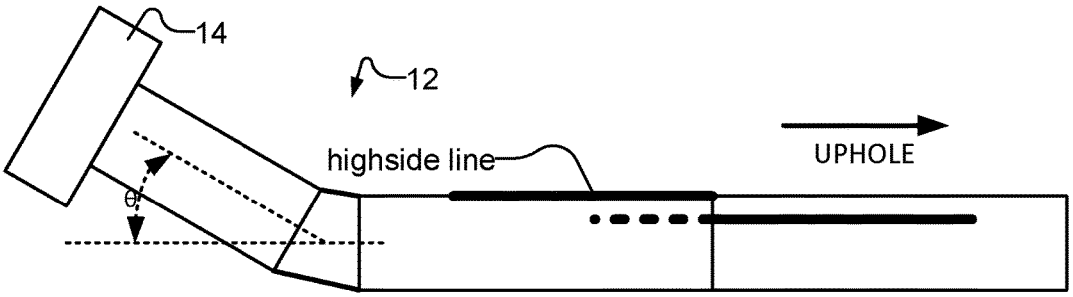
FIG. 1B – PRIOR ART – downhole configuration

APPARATUS FOR ANGULAR ALIGNMENT OF DOWNHOLE SENSORS WITH HIGH SIDE IN DIRECTIONAL DRILLING

CROSS-REFERENCE TO RELATED APPLICATIONS

This application claims priority from U.S. Application No. 61/738,389 filed 17 Dec. 2013. For purposes of the United States, this application claims the benefit under 35 U.S.C. § 119 of U.S. Application No. 61/738,389 filed 17 Dec. 2013 and entitled APPARATUS FOR ANGULAR ALIGNMENT OF DOWNHOLE SENSORS WITH HIGH SIDE IN DIRECTIONAL DRILLING which is hereby incorporated herein by reference for all purposes.

TECHNICAL FIELD

This application relates to subsurface drilling, specifically to directional drilling. Embodiments are applicable to drilling wells for recovering hydrocarbons. The invention relates particularly to drilling systems which use bent subs in combination with measuring while drilling (MWD) systems to steer drilling of wellbores.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Directional drilling involves guiding a drill bit in order to steer a well bore away from the vertical. Directional drilling may be used to cause a well bore to follow a desired path to a formation that is away to one side of the drill rig. Measurement while drilling (MWD) equipment is used to relay to the surface information from a probe located downhole. The information can be used by the crew of the drill rig to make decisions as to how to control and steer the well to achieve a desired goal most efficiently. The information may, for example, include inclination and azimuth of a portion of the drill string that includes a downhole probe.

In some directional drilling applications, a drill bit is turned by a mud motor in the bottom hole assembly. The mud motor is driven by high pressure drilling mud supplied from the surface. While the drill bit is being driven by the mud motor, it is not necessary to drive the drill bit by rotating the entire drill string.

Steering is typically accomplished by providing a bent sub, which is a section of the drill string which bends through an angle as opposed to being straight. FIG. 1B shows an example bent sub 20 in which the bent sub turns through an angle theta. The bent sub is typically located close to the drill bit. The bend in the bent sub causes the drill bit to address the formation being drilled into at an angle. This angle is primarily determined by the degree of bend of the bent sub.

The direction in which the bent sub deviates from the longitudinal axis of the drill string is called the high side. High side identifies a direction projecting radially outwardly from the main longitudinal axis of the drill string in the direction to which the bent sub is bent. The direction in which the drill bit will progress when driven by the mud motor is determined primarily by the orientation of the drill bit. This orientation may be defined by a "tool face" which is a plane perpendicular to the axis of rotation of the drill bit. The path taken by a well bore can be steered by turning the drill string such that the direction in which the drill bit is facing is changed.

Directional drilling is generally started by drilling a vertical section of wellbore. At some point, the drill is operated so that the wellbore deviates from the vertical forming a curve or 'dogleg'. The trajectory of the wellbore may change rapidly as a curve is formed in the wellbore. Allowing the wellbore to curve too tightly (forming a 'micro-dogleg') can cause problems. For example, casing may not fit easily through the micro-dogleg section. Repeated abrasion by the drill string at a micro-dogleg can result in worn spots in which the BHA may become lodged. Micro doglegs can also increase the overall friction of the drill string, resulting in increased potential for damage to the BHA.

Drillers require high quality timely information from downhole sensors to perform efficient and accurate directional drilling. Inaccurate or out-of-calibration information can result in a wellbore following a path that is inefficient and/or problematic. Mistakes in calibrating sensors can result in expensive consequences. There remains a need for ways to provide accurate telemetry information in directional drilling.

SUMMARY

This invention has various aspects. One aspect provides drill string sections that allow adjustment of the relative angle between a sensor reference axis and the high side of a bent sub. Another aspect provides downhole apparatus that includes a bent sub or other directional steering apparatus, a sensor, and a lockable swivel joint provided between the bent sub and the sensor. Other aspects of the invention provide methods for aligning sensors for downhole drilling and downhole drilling methods.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

FIGS. 1A and 1B illustrate schematically a drill string which includes a bent sub for directional drilling.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
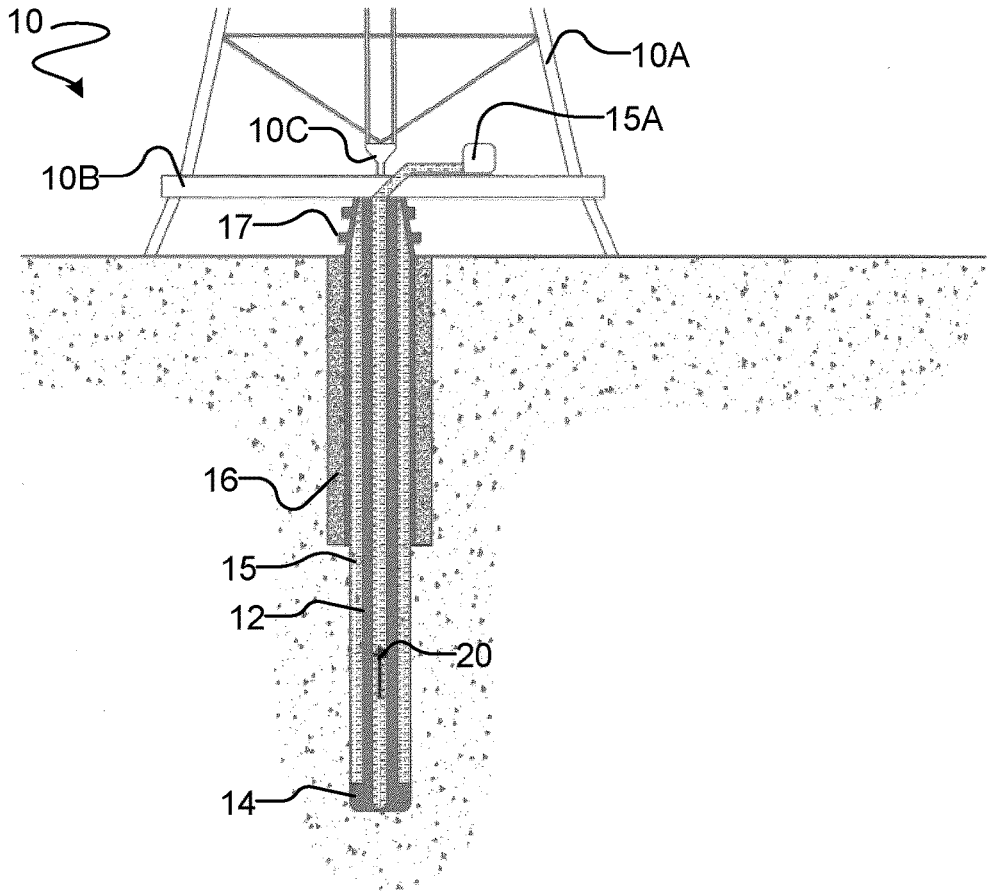
FIG. 1 shows an example drill rig.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

During directional drilling of a well bore, a driller typically begins by drilling a vertical section of the well bore and then causes the well bore to deviate from the vertical. This can be called "kicking off". The driller may receive measurements to assist in determining the trajectory being followed by the well bore. Measurements that may be provided from a downhole probe include inclination from vertical and azimuth (compass heading). A downhole probe typically includes various sensors that may include accelerometers to measure inclination, as well as magnetometers, to measure azimuth. Steering the drill to cause the wellbore to follow a desired path requires information as to the relative angular position of the tool face in the bore hole (known as the "roll").

To determine the roll from inclination and azimuth sensor readings, one needs to know how the sensors are aligned relative to the bent sub. The sensors are typically located in a downhole probe which is in a different drill string section from the bent sub. Consequently, the alignment of the sensors to the bent sub depends both on the alignment of the probe relative to the drill string section in which it is supported as well as the alignment of the drill string section holding the probe to the bent sub. Since drill string sections are typically coupled to one another by screw couplings, the relative angle between two coupled-together drill string sections can vary depending upon the torque applied to fasten the screw couplings as well as the degree to which the screw couplings may be worn. Consequently, calibration procedures must be undertaken in order to permit a driller to determine the current orientation of the bent sub based upon sensor readings received at the surface. These calibrations are susceptible to error.

Typically, the angular difference between a reference direction for downhole sensors and the high side direction of the bent sub is measured at the surface. The measured angular difference is entered as a calibration factor into MWD equipment. Measuring this angle is sometimes done by suspending the bottom hole assembly vertically on the drill rig. The operator may draw a chalk line up the drill string from the high side of the bent sub up to the drill string section containing the sensor. Another mark indicating a reference direction for the sensor may have previously been made on the drill string housing the directional sensor. The operator can then measure the angular difference between these two markings and then enter the measured angle (making sure the sign is correct) into the MWD equipment. Errors in measuring the angular relationship between the sensors in the probe and the drill string section housing the probe, errors in measuring the angle of the bent sub relative to the drill string section housing the probe, and errors in entering the resulting angle into MWD equipment can all lead to inaccuracies. In extreme cases, these inaccuracies can result in the well bore following a completely unintended path.

Embodiments of this invention provide a rotatable and lockable coupling in the drill string. The coupling may be provided between a bent sub or other steering component in a drill string and a probe. The coupling can be released to permit the bent sub to be swiveled relative to the probe. This construction permits the high side of the bent sub to be rotated relative to the probe to achieve a desired alignment between the high side of the bent sub and the probe. For example, the relative angle between the bent sub and a reference direction for the probe may be set to zero (such that no calibration factor is required).

The rotatable coupling must be suited to downhole conditions. One issue is that the drill string is subject to extreme torques. Consequently, the rotatable coupling and its locking mechanism must be sufficiently robust to withstand such torques while preventing relative rotation of the bent sub and the probe when the rotatable coupling is locked.

The rotatable coupling may have any of a large number of alternative constructions. One example construction which provides various advantageous features is illustrated in FIG. 2.

Figure 2:
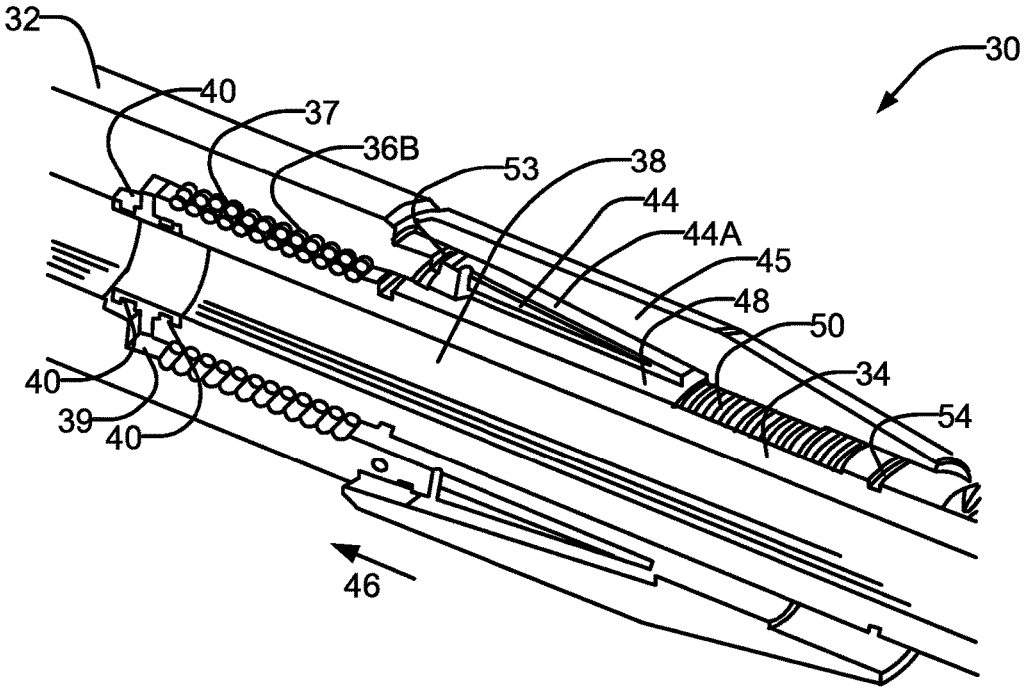
FIG. 2 is a cutaway view of an adjustable rotary coupling according to an example embodiment.
Figure 3:
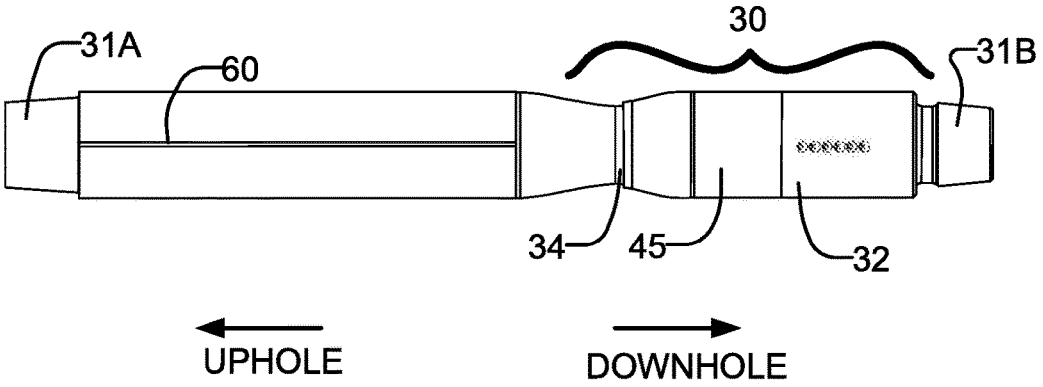
FIG. 3 is an elevation view of a drill string section incorporating a rotary coupling of the general type illustrated in FIG. 2.
Figure 4:
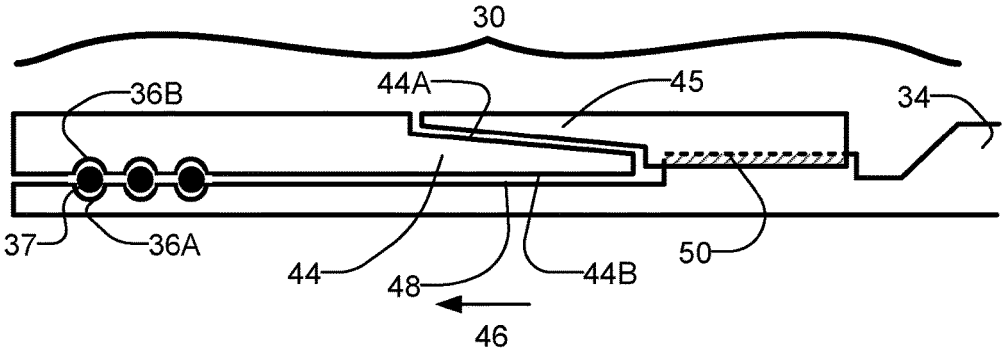
FIG. 4 is a schematic cross-sectional view of a portion of a locking mechanism for a rotary coupling.

FIG. 2 shows an example rotatable coupling 30. Coupling 30 may be incorporated into a drill string section. The drill string section may, for example, have standard couplings 31A and 31B on its uphole and downhole ends (see FIG. 3) for respective connection to an uphole part of the drill string comprising the probe and a downhole part of the drill string comprising the bent sub. The connections may, for example, comprise API threaded connections, as specified, for example, in API specification 7.

Rotatable coupling 30 permits relative rotation between a first tubular component 32 and a second tubular component 34. Parts 32 and 34 are coupled together in a manner which permits them to rotate relative to one another and also to transmit compressional and tensile forces. In the illustrated embodiment, parts 32 and 34 have a series of matching grooves 36A and 36B that are longitudinally spaced apart. Grooves 36A are provided in an inside diameter of part 32, whereas grooves 36B are provided on an outside of part 34. Each pair of grooves 36A and 36B defines between them a circumferential channel which can receive holding members. In the illustrated embodiment, the holding members comprise spherical balls 37. Balls 37 may, for example, be ceramic balls. Balls 37 can transmit longitudinally directed forces between parts 32 and 34 in either direction while still permitting free rotation of parts 32 and 34 relative to one another about the longitudinal axis of rotatable coupling 30.

A bore 38 extends through rotational coupling 30. Drilling fluid may be pumped through bore 38. A sealing member 39 prevents leakage of drilling fluids from bore 38 at the interface between parts 32 and 34. In the illustrated embodiment, sealing part 39 carries seals 40 which may, for example, comprise suitable O-rings. These seals also ensure that the collet and bearing surfaces remain clean.

Rotatable coupling 30 may remain concentric with a longitudinal centerline, which may be a centerline of bore 38 as well as an axis of couplings 31A and 31B for all angles of rotation.

Locking of joint 30 in rotation may be performed by means of a locking mechanism. In the illustrated embodiment the locking mechanism comprises tapered fingers 44 which extend from part 32 and a collar 45 having a tapered inner surface. Collar 45 may be moved longitudinally in the direction of arrow 46. Motion of collar 45 in direction 46 causes fingers 44 to be clamped against the outer surface 48 of part 34. In the illustrated embodiment, collar 45 threadedly engages threads 50 on the outside of part 34 so that collar 45 can be advanced in direction 46 by rotating collar 45 relative to part 34.

Seals 53 and 54 help to prevent contaminants from entering the area around fingers 44.

In some embodiments, top surfaces 44A of fingers 44 and the inner surface of collar 45 that bears against fingers 44 may be coated or surfaced in one or more materials that facilitate the sliding of collar 45 up along fingers 44. For example, one or more of these surfaces may be coated with Teflon. As another example, one or more of the surfaces may comprise a hard smooth material such as chard chrome or the like.

Similarly, outer surface 48 of part 34 with which the inner surfaces 44B of fingers 44 are forced into contact, as well as the inner surfaces of fingers 44 themselves, may be roughened or otherwise coated with a surface coating or surface treatment that resists slipping between fingers 44 and part 34. Such treatments can permit assembly 30 to resist large torques when collar 45 has been torqued to compress fingers 44 against part 34. Such treatments can also assist in preventing coupling 30 from rotating during tightening of collar 45. Collar 45 may be torqued using a drill rig such as drill rig 10.

In some embodiments, the inside diameter of fingers 44 is made slightly smaller than the outside diameter of part 34. In such embodiments, fingers 44 may be slightly flexed so that they apply some compressive forces to part 34 even when collar 45 is loose. The drag exerted by fingers 44 may assist in adjusting coupling 30 to a desired angle.

Figure 5:
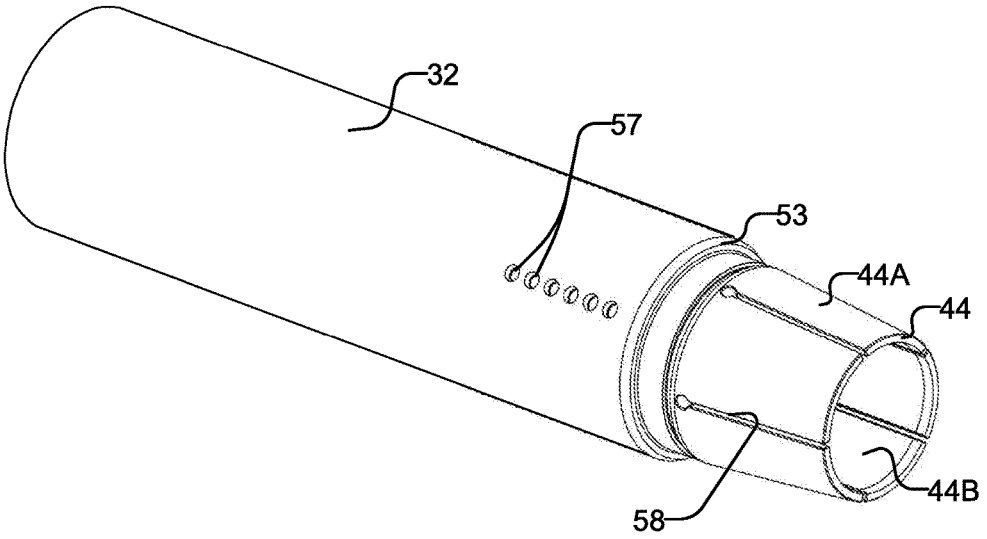
FIG. 5 is an isometric view of a collet member of the rotary coupling shown in FIG. 2.

FIG. 5 shows part 32. Holes 57 are provided for insertion of balls 37 into the channels defined by grooves 36A and 36B. Holes 57 may be subsequently plugged to prevent balls 37 from escaping. As shown in FIG. 5, fingers 44 may be separated from one another by longitudinally extending slits 58 so that fingers 44 can be compressed independently against part 34 by collar 45.

In use, a bent sub may be assembled onto a drill string comprising a rotary coupling 30, for example as described above. The high side of the bent sub may be aligned with an index line of the rotary coupling. For example, line 60 (see FIG. 3). A downhole probe comprising suitable sensors may be provided uphole from the rotatable coupling.

The drill string section containing the downhole probe may be marked on the outside with indicia such as a scribe line or the like to indicate the reference axis for the sensors that, ideally, would be aligned with the high side of the bent sub. Once the drill string has been assembled in this manner, the rotary coupling 30 can be loosened to permit the high side line of the bent sub to be lined up with the indicia indicating the orientation of the probe sensors. This alignment may be performed to any reasonable degree of accuracy. A coupling like coupling 30 can provide essentially infinite adjustment of the angle between parts 32 and 34.

When the desired alignment has been set, collar 45 may be tightened to lock rotary coupling 30 at the set angle.

While rotary coupling 30 as illustrated in FIGS. 2 to 5 is considered to provide a robust and easily used rotary coupling suitable for the purposes described above, other joints may also be used in the alternative. For example, a section of drill string may comprise two parts coupled together with a splined connection in which male splines on one part engage female splines on the other part. The two parts may be separated, rotated to any angle corresponding to an alignment of the splines, and then coupled together in the desired rotational position. The number of splines provided may be sufficient to provide a desired rotation angle. For example, 360 splines would permit rotation in increments of one degree. A threaded collar or other suitable coupling mechanism may be provided to hold the splined parts together in a desired engagement.

Other example constructions that permit a downhole part of a drill string to be rotated to a desired angle relative to an uphole part of the drill string and then locked in place may also be used. The rotation may be about a common axis (i.e. the rotary coupling may maintain the coupled parts of the drill string concentric with their longitudinal axes aligned. For example, two parts of a section of drill string may be rotatably coupled and locked at a desired angle by keys in keyways, splines, pins, bolts or setscrews that engage recesses, indentations or apertures, or the like. Locations of such fastening elements may be selected so as to enable the rotation to be adjusted in relatively small increments (e.g. 3 degrees, 2 degrees, 1 degree or less).

It is not necessary in all embodiments that the rotary coupling have a range of rotation of a full 360 degrees. In some applications it will be possible to couple a bent sub to a drill string in such a manner that the high side is within a certain angular range (e.g. 180 degrees or 90 degrees) of a desired angle relative to sensors in a downhole probe. In such embodiments a rotatable coupling adjustable through a portion of a full rotation may be applied.

Figure 6:
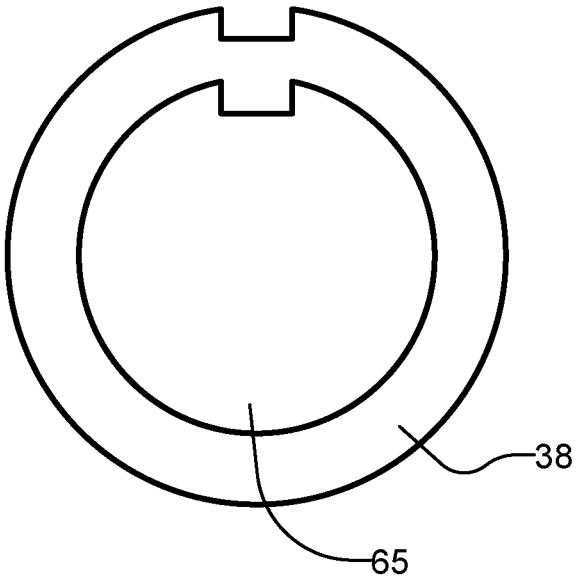
FIG. 6 schematically illustrates the keying of a downhole probe comprising sensors useful for steering a drill string with a section of a drill string.

In some embodiments, a downhole probe is supported in part 34. The downhole probe may be engaged in bore 38 in such a manner that the probe cannot rotate within bore 38 and also that the reference axis of sensors on the downhole probe are aligned with line 60. This is schematically indicated in FIG. 6 which schematically indicates a downhole probe 65 keyed within bore 38 in a manner which resists rotation of downhole probe 65.

Figure 7:
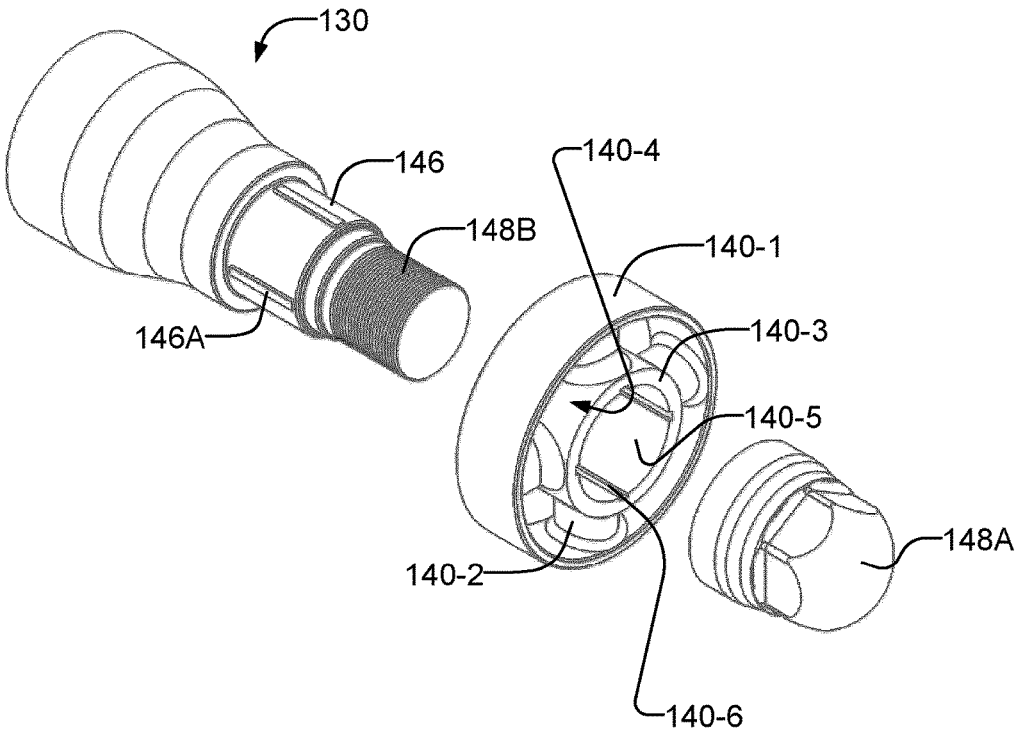
FIG. 7 is an exploded view of the end of a probe showing a non-limiting example structure for coupling a downhole probe non-rotationally into a section of drill string.

FIG. 7 shows an example construction for non-rotationally supporting a probe in a section of drill string. This construction is one example of a way in which a probe may be supported in part 34 such that a reference axis for one or more sensors in the probe coincides with line 60. In the illustrated embodiment, a spider is used to couple a downhole probe 130 into a section of drill string. Spider 140 has a rim 140-1 supported by arms 140-2 which extend to a hub 140-3 attached to downhole probe 130. Openings 140-4 between arms 140-2 provide space for the flow of drilling fluid past the spider 140.

To prevent relative rotation of spider 140 and probe 130, spider 140 may be integral with a part of the housing of probe 30 or may be keyed, splined, or have a shaped bore that engages a shaped shaft on probe 30 or may be otherwise non-rotationally mounted to probe 30. In the example embodiment shown in FIG. 7, probe 130 comprises a shaft 146 dimensioned to engage a bore 140-5 in hub 140-3 of spider 140. A nut 148A engages threads 148B to secure spider 140 on shaft 146. In the illustrated embodiment, shaft 146 comprises splines 146A which engage corresponding grooves 140-6 in bore 140-5 to prevent rotation of spider 140 relative to shaft 146. Splines 146A may be asymmetrical such that spider 140 can be received on shaft 146 in only one orientation. An opposing end of probe 130 (not shown in FIG. 7) may be similarly configured to support another spider 140.

Spider 140 may also be non-rotationally mounted to a drill string section 34 or to another section of the drill string above rotatable coupling 30. Coupling of the spider to the drill string section may, for example comprise one or more keys, splines, pins, bolts, shaping of the face or edge of rim 140A that engages corresponding shaping within bore 151 of the drill string section or the like. More than one key may be provided to increase the shear area and resist torsional movement of probe 130. In some embodiments one or more keyways, splines or the like for engaging spider 140 are provided on a member that is press-fit, pinned, welded, bolted or otherwise assembled to the drill string section in which the probe is supported. In some embodiments the member comprises a ring bearing such features.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.
- the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back"," "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A drill string section comprising:

an uphole part comprising an uphole coupling for coupling to an uphole part of a drill string;

a downhole part comprising a downhole coupling for coupling to a downhole part of the drill string;

a rotatable and lockable coupling arranged to couple together the uphole and downhole parts;

a bore extending through the uphole and downhole parts;

a locating feature in the bore of the uphole part for holding a downhole probe at a fixed rotation angle in the bore; and indicia on an outside of the uphole part indicating a desired highside alignment;

wherein the rotatable coupling comprises a first part having a bore and a second part received within the bore and the coupling comprises a locking mechanism comprising a plurality of tapered fingers extending axially from an end of the first part into a tapered bore in a collar engaged with and axially movable along the second part; and wherein one or both of inner surfaces of the fingers and an outer surface of the second part is configured to provide a high grip between the fingers and the second part.

2. The drill string section according to claim 1 wherein the collar is threadedly engaged with threads on an outside of the second part.

3. The drill string section according to claim 1 wherein outer surfaces of the fingers are coated with a friction reducing coating.

4. The drill string section according to claim 1 comprising a first threaded coupling on an uphole end of the drill string section and a second threaded coupling on a downhole end of the drill string section.

5. The drill string section according to claim 4 comprising a bore extending through the drill string section from the uphole end to the downhole end.

6. The drill string section according to claim 5 wherein a longitudinal centerline of the bore is coincident with an axis of rotation of the rotatable coupling.

7. The drill string section according to claim 4 in combination with a bent sub coupled to the downhole end of the drill string section.

8. The drill string section according to claim 7 in further combination with a second drill string section coupled to the uphole end of the drill string section, the second drill string section comprising the downhole probe.

9. A drill string section comprising:

an uphole part comprising an uphole coupling for coupling to an uphole part of a drill string;

a downhole part comprising a downhole coupling for coupling to a downhole part of the drill string;

a rotatable and lockable coupling arranged to couple together the uphole and downhole parts;

a bore extending through the uphole and downhole parts;

a locating feature in the bore of the uphole part for holding a downhole probe at a fixed rotation angle in the bore; and indicia on an outside of the uphole part indicating a desired highside alignment;

wherein the rotatable coupling comprises a first part having a bore and a second part received within the bore and the coupling comprises a locking mechanism comprising a plurality of tapered fingers extending axially from an end of the first part into a tapered bore in a collar engaged with and axially movable along the second part; and wherein the coupling comprises a plurality of grooves in an outer surface of the second part aligned with a plurality of corresponding grooves in an inner surface of the bore of the first part and a plurality of balls within the grooves.

10. The drill string section according to claim 9 wherein the balls comprise ceramic balls.

11. The drill string section according to claim 9 wherein the grooves extend circumferentially around the second part.

12. The drill string section according to claim 11 comprising plugged openings dimensioned to pass the balls extending through the first part into the grooves.

13. A drill string section comprising:

an uphole part comprising an uphole coupling for coupling to an uphole part of a drill string;

a downhole part comprising a downhole coupling for coupling to a downhole part of the drill string;

a rotatable and lockable coupling arranged to couple together the uphole and downhole parts, wherein the rotatable coupling comprises a first part having a bore and a second part received within the bore and the coupling comprises a locking mechanism comprising a plurality of tapered fingers extending axially from an end of the first part into a tapered bore in a collar engaged with and axially movable along the second part;

a bore extending through the uphole and downhole parts;

a locating feature in the bore of the uphole part for holding a downhole probe at a fixed rotation angle in the bore;

indicia on an outside of the uphole part indicating a desired highside alignment; and a sealing member between an end of the second part and a step in the bore of the first part.

14. A drill string section comprising:

an uphole part comprising an uphole coupling for coupling to an uphole part of a drill string;

a downhole part comprising a downhole coupling for coupling to a downhole part of the drill string;

a rotatable and lockable coupling arranged to couple together the uphole and downhole parts, wherein the rotatable coupling comprises a first part having a bore and a second part received within the bore and the coupling comprises a locking mechanism comprising a plurality of tapered fingers extending axially from an end of the first part into a tapered bore in a collar engaged with and axially movable along the second part;

a bore extending through the uphole and downhole parts;

a locating feature in the bore of the uphole part for holding a downhole probe at a fixed rotation angle in the bore;

indicia on an outside of the uphole part indicating a desired highside alignment; and first and second seals, the first seal arranged to seal between the collar and the first part, the second seal arranged to seal between the collar and the second part, the fingers being located between the first and second seals;

wherein the collar is threadedly engaged with threads on an outside of the second part.

15. The drill string section according to claim 14 wherein the threads of the coupling are between the seals.

16. A drill string section comprising:

an uphole part comprising an uphole coupling for coupling to an uphole part of a drill string;

a downhole part comprising a downhole coupling for coupling to a downhole part of the drill string;

a rotatable and lockable coupling arranged to couple together the uphole and downhole parts;

a bore extending through the uphole and downhole parts;

a locating feature in the bore of the uphole part for holding a downhole probe at a fixed rotation angle in the bore;

indicia on an outside of the uphole part indicating a desired highside alignment; and wherein the rotatable coupling comprises first and second splined parts wherein male splines on the first splined part are engageable with female splines on the second splined part wherein the splines are configured to permit the first and second splined parts to be separated and rotated to any angle corresponding to alignment of the splines and then to permit engagement of the splines; and wherein the splines comprise 360 splines to permit rotation in increments of one degree.

17. The drill string section according to claim 16 comprising a threaded collar arranged to hold the splines of the first and second splined parts in engagement.

18. A drill string section comprising:

an uphole part comprising an uphole coupling for coupling to an uphole part of a drill string;

a downhole part comprising a downhole coupling for coupling to a downhole part of the drill string;

a rotatable and lockable coupling arranged to couple together the uphole and downhole parts;

a bore extending through the uphole and downhole parts;

a locating feature in the bore of the uphole part for holding a downhole probe at a fixed rotation angle in the bore;

indicia on an outside of the uphole part indicating a desired highside alignment;

a first threaded coupling on an uphole end of the drill string section and a second threaded coupling on a downhole end of the drill string section;

a bent sub coupled to the downhole end of the drill string; and a second drill string section coupled to the uphole end of the drill string section, the second drill string section comprising the downhole probe, wherein the downhole probe comprises one or more vector quantity sensors.

19. The drill string section according to claim 18 wherein the rotatable coupling comprises a first part having a bore and a second part received within the bore and the coupling comprises a locking mechanism comprising a plurality of tapered fingers extending axially from an end of the first part into a tapered bore in a collar engaged with and axially movable along the second part.

* * * * *